United States Patent [19]

Hull et al.

[11] 4,415,176

[45] Nov. 15, 1983

[54] ELECTRONICALLY RELEASED SNOW SKI BINDING

[75] Inventors: Maury L. Hull, Winters; Lee Dorius, Davis, both of Calif.

[73] Assignee: The Regents of the University of California, Berkeley, Calif.

[21] Appl. No.: 270,925

[22] Filed: Jun. 5, 1981

[51] Int. Cl.[3] ..... A63C 9/08

[52] U.S. Cl. ..... 280/612; 280/624

[58] Field of Search ..... 280/612, 624, 625, 626, 280/623

[56] References Cited

U.S. PATENT DOCUMENTS 3,927,897 12/1975 Olson et al. ..... 280/612
4,291,894 9/1981 D'Antonio et al. ..... 280/612

FOREIGN PATENT DOCUMENTS 2907939 9/1979 Fed. Rep. of Germany ..... 280/612
2925375 1/1981 Fed. Rep. of Germany ..... 280/612
2374922 8/1978 France ..... 280/612

*Primary Examiner*—Joseph F. Peters, Jr.
*Assistant Examiner*—Michael Mar
*Attorney, Agent, or Firm*—Fitch, Even, Tabin & Flannery

[57] ABSTRACT

A ski binding for releasably securing a ski boot to a ski includes strain gages mounted between the ski and the ski binding housing. The strain gages measure forces induced on the binding and develop electrical signals commensurate thereto. The signals are analyzed to develop a release signal when any component of a force exceeds a predetermined limit. The ski binding includes bias elements for maintaining a pair of clamps in a locked position for securing a boot plate of the ski boot to the housing and in response to the release signal releases the clamps to free the ski boot from the ski binding to prevent injury to the user.

8 Claims, 4 Drawing Figures

FIGURE 3
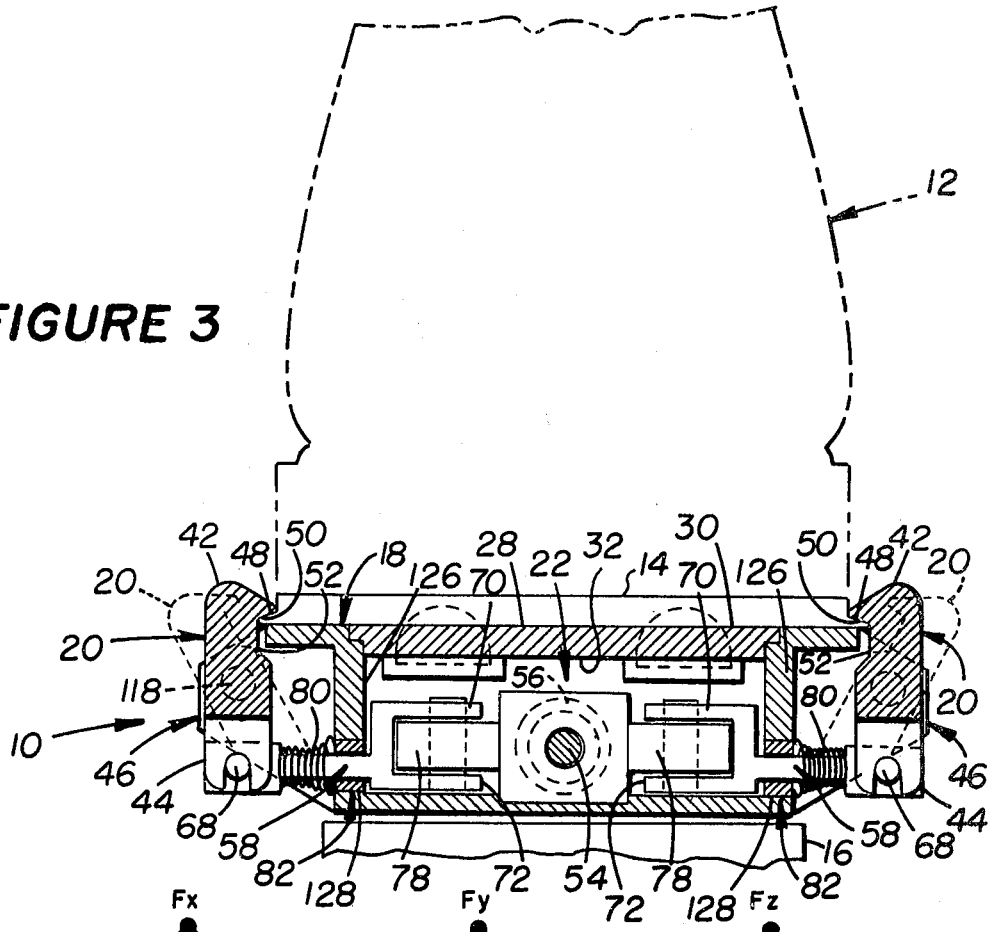
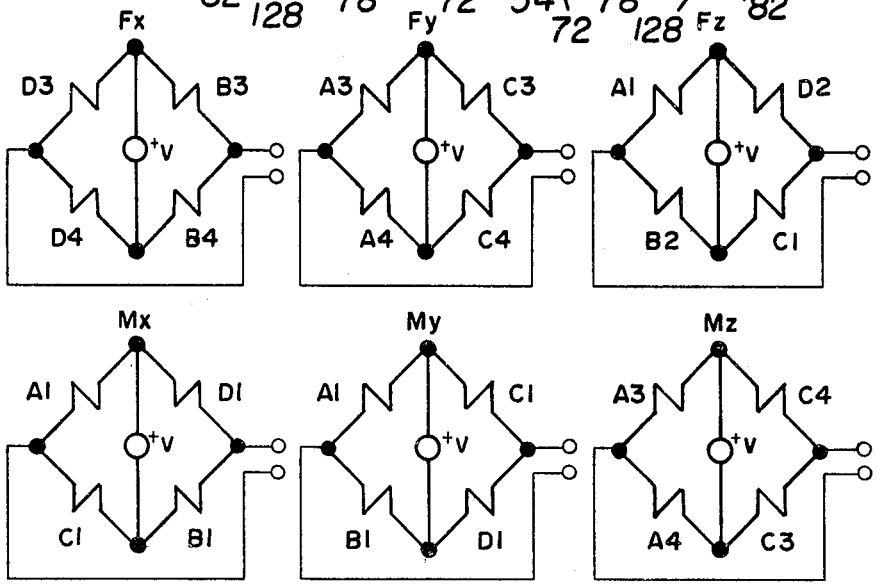
FIGURE 4

ELECTRONICALLY RELEASED SNOW SKI BINDING

DESCRIPTION

BACKGROUND OF THE INVENTION

FIELD OF THE INVENTION

The present invention relates generally to ski bindings and more particularly to electronically actuated ski binding for initiating release within the binding in order to prevent or minimize injuries, especially in the lower extremities of the skier.

In view of the increasing popularity of snow skiing, a wide variety of ski bindings have been developed and made commercially available. However, even with improvement of such bindings, the increase in popularity and practice of snow skiing has been accompanied by an increase in injuries, especially in the lower extremities of skiers. Generally, ski injuries have tended to concentrate in the tibia, in the form of mid-length fracture as well as in the ankle and knee.

There has been a substantial effort to improve all types of ski equipment for minimizing such injuries including improvements in ski boots and skis themselves as well as in the ski bindings. However, much effort directed toward the elimination or prevention of such injuries has concerned the binding since it has been found that releasing the skier from the ski is one of the most effective means of protecting the skier during injury provoking situations such as falls and the like.

A copending application entitled Method and Apparatus for Programmed Release of Ski Bindings, Ser. No. 162,413, filed June 24, 1980, now U.S. Pat. No. 4,371,188, by Maury L. Hull, one of the inventors herein, is directed toward a method and apparatus for achieving programmed release in ski bindings through the operation of control circuits which may comprise for example either analog or digital components. The control circuit described in that application is programmed according to equations developed in a biomechanical model in order to adapt the control circuit for computing predetermined release variables and for comparing those release variables to release criterion in order to precisely generate a release initiating signal.

Another copending application entitled Ski Binding with Universal Release, Ser. No. 177,263, filed Aug. 11, 1980, now U.S. Pat. No. 4,361,344, by Maury L. Hull, one of the inventors herein, is directed to a ski binding including releasable binding means for rigidly securing a ski boot to the ski with a release actuating element for releasing the ski boot from the binding upon occurrence of a release condition determined by the control circuit in the prior copending application. The releasable binding means includes circular elements, nested one within the other, and detent means being adapted for selectively locking the elements together while being capable of unlatching the elements upon operation of the release actuating element.

SUMMARY OF THE INVENTION

According to the principles of the present invention, a ski binding for releasably securing a ski boot having a boot plate to a ski includes a housing having a generally elongated platform, a pair of clamps, each clamp being rotatably mounted in a facing relationship to a different one of lateral edges of the platform and being rotatable between a first position and a second position, bias means for maintaining the clamps in the first position, dynamometer means for measuring dynamic forces induced between the platform and the ski, and control means operative to develop a release signal when one of the forces exceeds one of the predetermined limits. The dynamometer means develops a plurality of electrical signals, each of the signals being associated with a measurement of a different one of components of the dynamic forces. The control means is responsive to these signals and develops a release signal when one of the components exceeds the determined limit. The bias means is responsive to the release signal and operative to rotate the clamps to the second position to release the boot from the ski binding.

BRIEF DESCRIPTION OF THE DRAWINGS

FIG. 3 is a cross-sectional view taken along line 3—3 of FIG. 1; and FIG. 4 illustrates several representations of the arrangement of strain gages shown in phantom in FIG. 1.

DETAILED DESCRIPTION OF THE DRAWINGS

Figure 1:
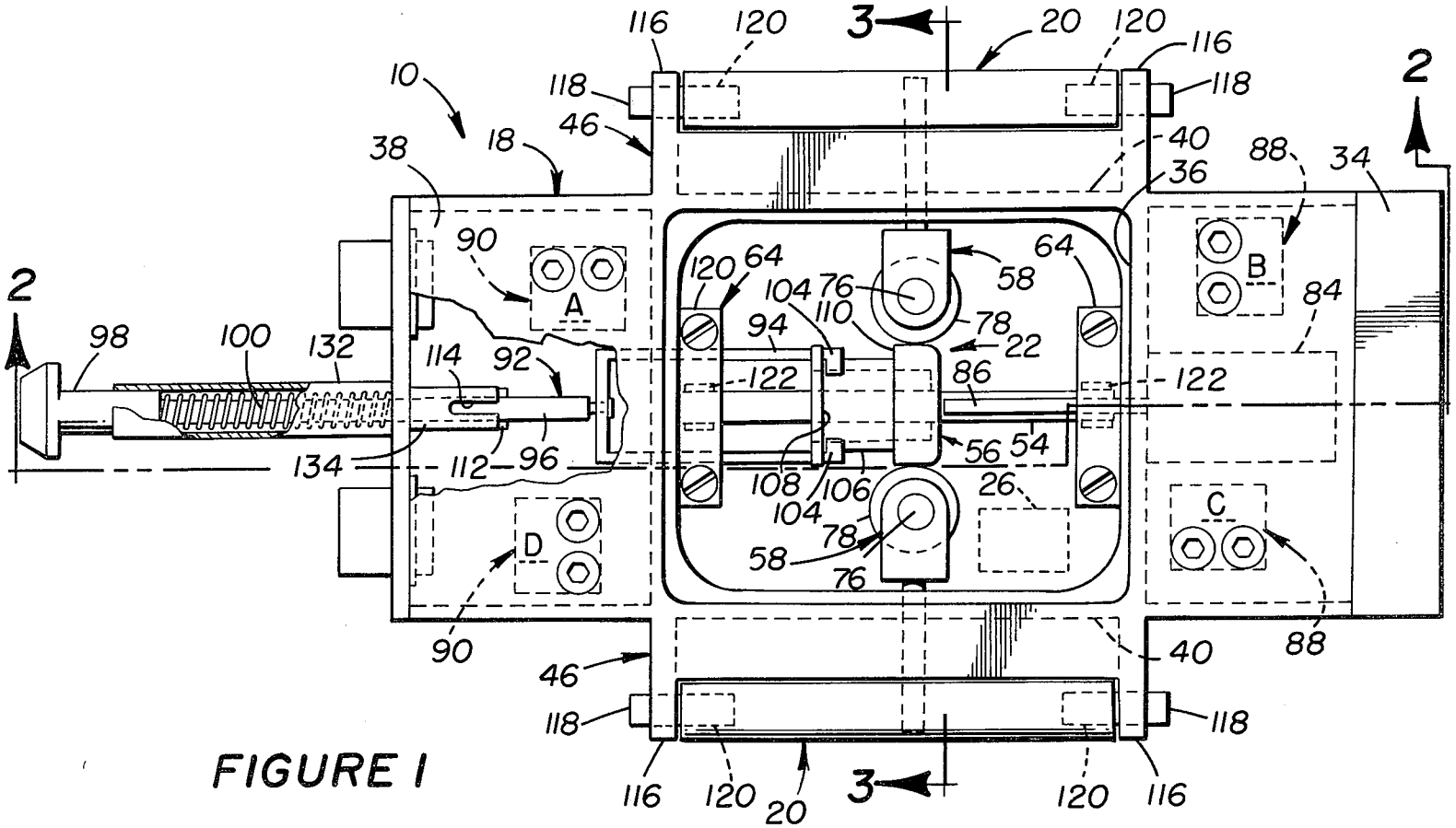
FIG. 1 is a plan view, partially broken away, showing an embodiment of a ski release binding according to the principles of the present invention.
Figure 2:
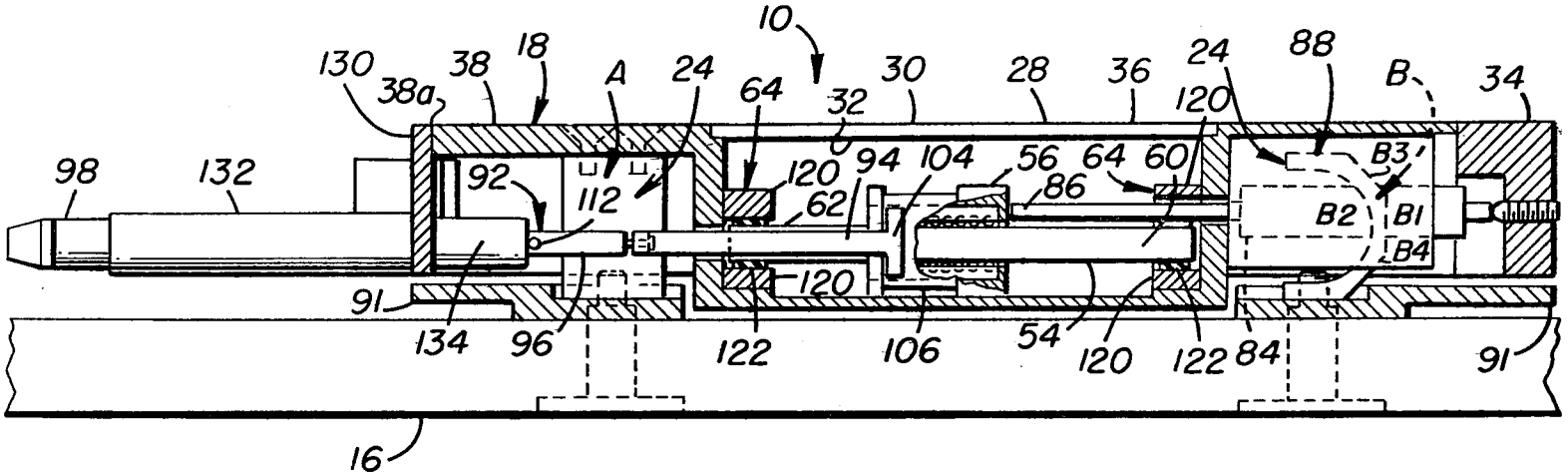
FIG. 2 is a cross-sectional view taken along line 2—2 of FIG. 1.

Referring now to FIGS. 1–3, there are shown a ski binding 10, a ski boot 12 having a boot plate 14, and a ski 16. Ski binding 10 releasably secures ski boot 12 to ski 16.

Ski binding 10 includes a housing 18, a pair of clamps 20, bias means 22, dynamometer means 24, and control means 26.

Housing 18 defines a generally elongated platform 28. Platform 28 has an upper side 30, a lower side 32, a forward portion 34, a middle portion 36 and a rearward portion 38. Middle portion 36 has a pair of lateral edges 40.

Each clamp 20 includes an upper end portion 42 and a lower end portion 44. Housing 18 further includes first mounting means 46 for rotationally mounting each clamp 20 in a facing relationship to a different one of each lateral edge 40. As best shown in FIG. 3, each clamp 20 is rotatable between a first position as illustrated therein and a second position shown in phantom.

Upper end portion 42 of each clamp 20 is adapted to secure boot plate 14 to upper side 30 of elongated platform 28. As best shown in FIG. 3, boot plate 14 may include a rib 48 extending outwardly from the lateral periphery thereof. An upper surface 50 of rib 48 is angled downwardly from the horizontal plane. Upper end portion 42 of clamp 20 may include a notch 52, dimensioned to engage rib 48. When each clamp 20 is in the first position, boot plate 14 is secured to upper side 30 of elongated platform 28. When each clamp 20 is rotated to the second position, boot plate 14 (as well as ski boot 12) is free to separate from ski binding 10. The angled upper surface of rib 48 eliminates frictional resistance between rib 48 and notch 52 when clamp 20 is being rotated to the second position.

Dynamometer means 24 secures forward portion 34 and rearward portion 38 in a spaced apart relationship to skis 16. As hereinafter described, dynamometer means 24 further measures dynamic forces induced between elongated platform 28 and ski 16 and develops a plurality of signals, each of the signals being associated with a measurement of a different one of components of the dynamic forces.

The details of control means 26 have been fully described in copending application entitled Method and Apparatus for Programming Release in Ski Bindings, Ser. No. 162,413, filed June 24, 1980 by Maury L. Hull, and more particularly in FIGS. 1 through 6 therein, and are incorporated herein by reference as if set forth fully at this point.

Bias means 22 includes a generally elongated rod 54, a generally cylindrical member 56, and a pair of roller structures 58.

Elongated rod 54 has a first end portion 60 and a second end portion 62. Housing 18 further includes second mounting means 64 for longitudinally mounting in a spaced apart relation first end portion 60 and second end portion 62 underneath middle portion 36.

Cylindrical member 56 has an axial bore 66 dimensioned to receive rod 54. Cylindrical member 56 is mounted in axially slidable engagement on rod 54.

Each roller structure 58 has an outer end 68 adapted for mounting to lower end portion 44 of clamp 20 in rotationally slidable engagement, a generally U-shaped inner end 70 defining a pair of free ends 72, an elongated member 74 connecting outer end 68 and inner end 70, an axle 76 mounted to free end 72, a roller 78 rotatably mounted on axle 76, and a bias element 80 arranged for normally biasing roller structure 58 to maintain each clamp 20 in the second position. Axle 76 is arranged generally perpendicular to elongated platform 28. Housing 18 further includes third mounting means 82 for supporting elongated member 74 in linear slidable engagement.

Cylindrical member 56 is positionable between roller 78 of each roller structure 58 defining a locked position for biasing each roller structure 58 to maintain each clamp 20 in the first position, as best shown in FIGS. 1 and 3.

Bias means 22 further includes a solenoid 84 having a plunger 86. Cylindrical member 56 when in the locked position is positioned proximate plunger 86.

Control means 26, as described in the hereinabove referenced application, develops a release signal when any component of the forces measured by dynamometer means 24 exceeds a predetermined limit. Solenoid 84 in response to the release signal projects plunger 86 toward cylindrical member 56. Plunger 86 urges cylindrical member 56 towards one end portion, such as second end portion 62, of elongated rod 54 defining an unlocked position. Cylindrical member 56 after being displaced from the locked position allows roller structures 58 to translate inwardly to move each clamp 20 to the second position.

Dynamometer means 24 includes first strain gage means 88 associated with forward portion 34 and second strain gage means 90 associated with rearward portion 38. First and second strain gage means 88 and 90 developed at the electrical signals as hereinabove described in response to the forces developed between elongated platform 28 and ski 16.

First and second strain gage means 88 and 90 include four half strain rings, shown herein as A, B, C and D. Each half strain ring has thereon four strain gage elements, strain ring B in FIG. 2 being representative thereof showing B1, B2, B3 and B4. Referring now also to FIG. 4, the inner connections between all strain gages of strain rings A, B, C and D are shown as bridge circuits which measure the axial components of force $F_x$, $F_y$ and $F_z$, and the moments about the axial components, $M_x$, $M_y$ and $M_z$. The bridge innerconnections, as shown in FIG. 4, develop the electrical signals to which the control means is responsive to, as explained in the hereinabove referenced application. A different plate 91 is positionable between each strain ring A, B, C and D and ski 16.

Returning now to FIGS. 1–3, ski binding 10 further includes manually operable locking means 92 for selectively engaging bias means 22 to position clamps 20 in either the first position or the second position.

Locking means 92 includes the generally U-shaped harness 94, a generally elongated rod 96 rotatably connected to harness 94 at one end portion thereof, a handle 98 mounted to another end portion of rod 96, and a bias spring 100. Housing 18 further includes fourth mounting means 102 for supporting locking means 92 in linear slidable engagement.

Harness 94 includes a pair of arcuate fingers 104. Cylindrical member 56 further includes a reduced diameter portion 106 defining a first and second shoulder 108 and 110. Arcuate fingers 104 are in axially slidable engagement with reduced portion 106 between shoulders 108 and 110. In the locked position as shown in FIG. 1, arcuate fingers 104 are adjacent first shoulder 108. Should solenoid 84 displace cylindrical member 56 in response to the release signal as hereinabove described, cylindrical member 22 is axially displaced until arcuate fingers 104 contact second shoulder 110. Depression of handle 98 causes arcuate fingers 104 to push against second shoulder 110 to replace cylindrical member 56 to the locked position of FIG. 1. Bias spring 100 will return locking means 92 to its normal position as shown in FIG. 1.

In order to place cylindrical member 56 in the unlocked position by using locking means 92, handle 98 is rotated until a projection 112 radially extending from rod 96 is aligned with an axial slot 114 of fourth mounting means 102. Bias spring 110 will urge locking means 92 outward, arcuate fingers 104 exerting a pull on first shoulder 108 to remove cylindrical member 56 from the locked position.

First mounting means 46 includes two pairs of arms 116 and a plurality of pins 118. Each pin 118 is mounted generally perpendicular to a different one of each arm 116. On each pair of arms 116, pins 118 define an axis of rotation for clamp 20. Each clamp 20 includes an aperture 120 at each end thereof to receive pin 118 in rotationally slidable engagement.

Second mounting means 64 includes two pairs of mounting blocks 120, and an elastomeric bushing 122 associated with each pair of blocks 120. Fasteners 124 secured blocks 120 to housing 18. First and second end portion 60 and 62 are secured within each pair of blocks 120 by bushings 122. Bushings 122 absorb impact forces when plunger 86 strikes cylindrical member 56 to minimize friction between cylindrical member 56 and rod 54.

Third mounting means 82 includes a pair of walls 126 extending downwardly from lower side 32, each wall being adjacent a different lateral edge 40 of middle portion 36. Each wall 126 has a bearing element 128 dimensioned commensurate with elongated member 74 for minimizing friction therebetween.

Fourth mounting means 102 includes a wall 130 extending downwardly from an edge **38*a* of rearward portion 38, a first tube 132** extending rearwardly of wall 130 and a second tube 134 extending forwardly of wall 130 and being coaxial with first tube 132. First tube 130 is dimensioned to receive handle 98 in linear slidable engagement spring 100 being disposed coaxially around rod 96 to exert against handle 98 and wall 130. Second tube 132 is dimensioned to receive rod 96 and also has axial slot 114 as hereinabove described.

Although the present invention has been described with reference to a particular embodiment thereof, those skilled in the art may now make numerous uses of and modifications to the present invention without departing from the inventive concepts disclosed herein. The present invention is to be limited only by the scope of the appended claims.

What is claimed is:

1. A ski binding for releasably securing a ski boot having a boot plate to a ski, said ski binding comprising:

a housing defining a generally elongated platform having an upper side, a lower side, a forward portion, a middle portion and a rearward portion, said middle portion having a pair of lateral edges;

a pair of clamps, each of said clamps including an upper end portion and a lower end portion, said housing further including first mounting means for rotationally mounting each of said clamps in a facing relationship to a different one of each of said lateral edges, each of said clamps being rotatable between a first position and a second position, said upper end portion being adapted for securing said boot plate to said upper side when each of said clamps is in said first position;

bias means for maintaining each of said clamps in said first position, said upper end portion of each of said clamps being adapted for securing said boot plate to said upper side when each of said clamps are in said first position;

a first pair of strain rings mounted to said forward portion of said platform and a second pair of strain rings mounted to said rearward portion of said platform, means for mounting said first pair and said second pair of strain rings to the surface of said ski, wherein said housing is mounted on said ski in a spaced apart relationship, each of said strain rings having a plurality of strain gages thereon, said strain gages measuring flexure of said strain rings in response to dynamic forces causing relative movement between said platform and said ski and being interconnected to develop a plurality of electrical signals as a function of components of said forces, each of said electrical signals being associated with one of said components;

control means responsive to said signals for analyzing said signals and operative to develop a release signal upon one of said components exceeding a predetermined limit, said bias means being further responsive to said release signal and operative to rotate each of said clamps to said second position.

2. A ski binding according to claim 1 further comprising:

manually operable locking means for selectively engaging said bias means and operative to selectively position each of said clamps in one of said first position and said second position.

3. A ski binding for releasably securing a ski boot having a boot plate to a ski, said ski binding comprising:

a housing defining a generally elongated platform having an upper side, a lower side, a forward portion, a middle portion and a rearward portion, said middle portion having a pair of lateral edges;

a pair of clamps, each of said clamps including an upper end portion and a lower end portion, said housing further including first mounting means for rotationally mounting each of said clamps in a facing relationship to a different one of each of said lateral edges, each of said clamps being rotatable between a first position and a second position, said upper end portion being adapted for securing said boot plate to said upper side when each of said clamps is in said first position;

a generally elongated rod having a first end portion and a second end portion, said housing further including second mounting means for longitudinally mounting in a spaced apart relation each of said first end portion and said second end portion underneath said middle portion;

a generally cylindrical member having an axial bore dimensioned to receive said rod, said member being mounted in axially slidable engagement on said rod and movable between a locked position and an unlocked position;

a pair of roller structures, each of said roller structures having an outer end adapted for mounting to said lower end portion of a different one of each of said clamps in rotationally slidable engagement, a generally U-shaped inner end defining a pair of free ends, an elongated member connecting said outer end and said inner end, an axle mounted to said free ends, a roller rotatably mounted on said axle, and a bias element arranged for normally biasing each of said roller structures to maintain each of said clamps in said second position when said cylindrical member is in said unlocked position, said axle being arranged generally perpendicular to said platform, said housing further including third mounting means for supporting said elongated member of each of said roller structures in linear slidable arrangement;

dynamometer means for securing said forward portion and said rearward portion in a spaced apart relationship to said ski and further for measuring dynamic forces induced between said platform and said ski and operative to develop a plurality of electrical signals, each of said signals being associated with a measurement of a different one of components of said forces; and control means responsive to said signals for analyzing said signals and operative to develop a release signal upon one of said components exceeding a predetermined limit, said cylindrical member being urged to said second position thereof in response to said release signal for causing rotation of each of said clamps to said second position.

4. A ski binding according to claim 3 wherein said cylindrical member is positionable between said roller of each of said roller structures in said locked position for biasing each of said roller structures to maintain each of said clamps in said first position.

5. A ski binding according to claim 4 wherein said bias means further includes:

a solenoid having a plunger, said cylindrical member in said locked position being axially positioned proximate said plunger.

6. A ski binding according to claim 5 in which said solenoid in response to said release signal projects said plunger towards said cylindrical member, said plunger sliding said cylindrical member towards one of said end portions of said rod in said unlocked position.

7. A ski binding for releasably securing a ski boot having a boot plate to a ski, said ski binding comprising:

a housing defining a generally elongated platform having an upper side, a lower side, a forward portion, and middle portion and a rearward portion, said middle portion having a pair of lateral edges;

a pair of clamps, each of said clamps including an upper end portion and a lower end portion, said housing further including first mounting means for rotationally mounting each of said clamps in a facing relationship to a different one of each of said lateral edges, each of said clamps being rotatable between a first position and a second position, said upper end portion being adapted for securing said boot plate to said upper side when said clamps are in sair first position;

a cylindrical member slidably mounted between said lateral edges of said middle portion and movable along a line generally parallel to said lateral edges between a locked position and an unlocked position;

means for maintaining said clamps in said first position when said cylindrical member is in said locked position;

a first pair of stain rings mounted to said forward portion of said platform and a second pair of strain rings mounted to said rearward portion of said platform, means for mounting said first pair and said second pair of strain rings to the surface of said ski, wherein said housing is mounted on said ski in a spaced apart relationship, each of said strain rings having a plurality of strain gages thereon, said stain gages measuring flexure of said strain rings in response to dynamic forces causing relative movement between said platform and said ski and being interconnected to develop a plurality of electrical signals as a function of components of said forces, each of said electrical signals being associated with one of said components;

control means responsive to said signals for analyzing said signals and operative to develop a release signal upon one of said components exceeding a predetermined limit; and means responsive to said release signal for urging said cylindrical member toward said unlocked position to allow said clamps to rotate towards said second position.

8. A ski binding according to claim 7 further comprising:

a harness structure in slidable engagement with said cylindrical member, said cylindrical member further having a flange disposed at each end thereof, said harness structure engaging said cylindrical member intermediate said flange and selectively engaging one of said flanges for manually positioning said cylindrical member into a selected one of said locked position and said unlocked position.

* * * * *